United States Patent [19]

Weinhold et al.

[11] 4,413,585

[45] Nov. 8, 1983

[54] PROCESS AND ARRANGEMENT FOR APPLYING AND DRYING LIQUID LUBRICANT

[75] Inventors: Harri Weinhold, Kreischa; Heinz-Rüdiger Vogel; Bernhard Kurze, both of Dresden; Joachim Schlegel, Freiberg; Dieter Rauschenbach, Dresden; Roland Hering; Peter Werner, both of Mittweida; Heinz Wünsch, Lauenhain, all of German Democratic Rep.

[73] Assignee: Veb Schwermaschinenbau Kombinat "Ernst Thalmann"Magdeburg, Magdeburg, German Democratic Rep.

[21] Appl. No.: 169,931

[22] Filed: Jul. 17, 1980

[51] Int. Cl.[3] ..... B05C 3/12

[52] U.S. Cl. ..... 118/61; 118/65; 118/67; 118/68; 118/125; 118/405; 118/419; 118/DIG. 18; 427/434.7

[58] Field of Search ..... 118/65, 67, 68, 405, 118/125, 61, 419, DIG. 18; 427/434.7

[56] References Cited

U.S. PATENT DOCUMENTS

| | | | |
|---|---|---|---|
| 1,983,764 | 12/1934 | Lane et al. | 118/67 |
| 2,542,064 | 2/1951 | Tilden | 118/67 |
| 2,833,672 | 5/1958 | Laubscher et al. | 118/67 |
| 2,894,483 | 7/1959 | Stahl | 118/67 |
| 3,291,639 | 12/1966 | Flowers | 118/67 |
| 3,313,646 | 4/1967 | Van Zalinge | 118/67 |
| 3,346,413 | 10/1967 | Lindemann | 427/345 |
| 3,551,189 | 12/1970 | Gray | 427/345 |
| 3,877,975 | 4/1975 | Raymond | 427/345 |

*Primary Examiner*—Norman Morgenstern
*Assistant Examiner*—Richard Bueker
*Attorney, Agent, or Firm*—Michael J. Striker

[57] ABSTRACT

A process of applying and drying a liquid lubricant on a metallic material to be mechanically worked has the steps of passing a metallic material through a coating container with a lubricant so that the lubricant coats the metallic material and the latter exits from the coating container through an opening, removing the superfluous portion of the lubricant without contacting the same with outside air, and advancing the lubricant coated metallic material through a drying channel in which air is urged in disturbed state. An arrangement for performing the method is also provided.

12 Claims, 6 Drawing Figures

PROCESS AND ARRANGEMENT FOR APPLYING AND DRYING LIQUID LUBRICANT

BACKGROUND OF THE INVENTION

The present invention relates to processes for cold mechanical working of metallic materials.

More particularly, the present invention relates to applying and drying lubricants which is liquid at room temperature, on the metallic material to be mechanically worked, especially of lubricants which include an organic solvent and solid or semi-solid lubricant substance accommodated therein. The metallic material may be in form of, for example, wires, rods and tubes, which are coated by a lubricant for hydrodynamic lubrication during drawing processes.

For applying liquid lubricating substances onto metallic materials to be mechanically worked by drawing it is known to pass the metallic material through an open box containing the lubricating substance. The striping off element is arranged in the inlet and the outlet, the striping off element formed by a felt or synthetic plate with a slot through which the metallic material passes. These striping off elements fill the box and at the same time guarantee the formation of a lubricant film. Such arrangement possesses the following disadvantage. The solvent contained in the lubricant can evaporate whereby a depletion of the solvent takes place, and in the case of special solvents additional health protection measures must be taken. It is also disadvantageous that the arrangement can function only in horizontal position. Moreover, a continuously uniform application of the lubricant is not guaranteed inasmuch as the stripping off elements tend to wear very fast. In the case of the wear, great quantities of lubricant exit from the box. Since the outer face of the metallic material in this case has impurities, for example fat rests, this arrangement cannot provide for closed lubricant film.

When lubricant is liquid and formed by a solution or dispersion of solid or semi-solid lubricating substance, the liquid lubricant layer applied on the metallic material must be dried before the tool for mechanical working in order to utilize the advantages of the solid or semi-solid lubricant. This means that the liquid contained in the lubricant must be removed before the insertion of the metallic material into the working tool. The removal must be performed very thoroughly, because the dynamic viscosity of the lubricant decreases in the case of insufficient drying. It is known to remove the liquid by drying the metallic material in drying oven. This method is time consuming especially for lubricants which contain a liquid with high boiling point. This is even more disadvantageous in the case of continuous coating with subsequent mechanical working as well as in the case of continuous multistage mechanical working with intermediate coating, since in these cses only low working speeds can be attained. Moreover, the energy expenses and technological expenses for drying by heated air are relatively high. In the case of the lubricant layers containing the organic solvents, this method cannot be utilized inasmuch as the requirements to the protection of workers' health and fire protection are not completely satisfied.

SUMMARY OF THE INVENTION

Accordingly, it is an object of the present invention to provide a process of and an arrangement for applying and drying a liquid lubricant on a metallic material to be mechanically worked, which is characterized by increase of the quality of the lubricant coating, reduction of lubricant consumption, and reduction of expenditures required for protection of the workers' health.

A concomitant object of the present invention is to provide the abovementioned process and arrangement which allows, during drying the lubricant layers, particularly those containing an organic solvent, to reduce the expenditures and to guarantee the workers' health protection and fire protection.

It is another object of the present invention to provide a process and arrangement which allows economical consumption of lubricant and at the same time makes possible to produce a uniform and fast drying lubricant film in such a manner that wear of insertable parts of the arrangement does not affect the quality of the film.

In keeping with these objects and with others which will become apparent hereinafter, one feature of the present invention resides, briefly stated, in a method for applying and drying liquid lubricant on a metallic material to be mechanically worked, particularly a lubricant containing an organic solvent and solid or semi-solid lubricating substance, in accordance with which the metallic material passes through openings of a closed coating container and thereafter through a drying channel, wherein the coating container is a part of a closed lubricant circuit and superfluous lubricant exiting from one of the openings is collected without contacting with the outside air, and wherein air is forcedly aspirated or blown through the drying channel so as to cause turbulence and/or pressure change, which can recuperate the solvent, if necessary.

In accordance with another advantageous feature of the present invention, the lubricant is applied onto the heated material to be worked, wherein heat is generated in the material because of mechanical working or friction during the preceding working process or by an external heat or energy source, and utilized for drying purposes. The lubricant can be advanced through the coating container in heated or cooled state.

In accordance with a further feature of the present invention, the lubricant and the coated material can contact with each other in th coating container inside of a granular filler. The granular filler may be formed by granular particles of a polymeric material which possesses non-absorption properties and/or is foamed with open pores.

For obtaining the turbulence, in accordance with still a further feature of the present invention, air is supplied and/or withdrawn along the drying channel in dosed quantities.

Still another feature of the present invention is embodied in an arrangement for carrying out the inventive method. The arrangement has a closed coating container forming a part of a closed lubricant circuit and having openings so that a metallic material passes through the coating container and lubricant coats the metallic material, means for removing the superfluous portion of lubricant which exits via one of the openings, without contacting the superfluous portion of the lubricant with outside air, a drying channel located downstream of the removing means and the coating container and arranged to pass the lubricant coating metallic material therethrough, means for urging air through the interior of the drying channel and connected with the latter, and means for disturbing the air in the drying channel.

The coating container may be located inside a closed lubricant collecting container and have lubricant inlet and outlet which are connected with one another for forming a closed lubricant circuit via a lubricant reservoir and a lubricant pump.

In accordance with yet another advantageous feature of the invention, the coating container and the lubricant collecting container have inlet and outlet openings for the material, and the outlet opening of the collecting container is provided with a nozzle for obtaining a predetermined thickness of the lubricant layer.

A granular filler may be arranged in the coating container in the region of the inlet and outlet openings, and above a sieve so that a lubricant supply conduit opens into the granular filler, whereas a lubricant collecting zone is formed below the sieve and is connected with the lubricant reservoir.

Finally, for obtaining the turbulent air stream and/or the pressure change in the drying channel, baffles may be provided in the drying channel so as to subdivide the latter into a plurality of chambers. On the other hand, conical nozzles may be provided in the drying channel. Pipes for supplying or withdrawing air may also be provided and open into the drying channel for additionally reducing the concentration of solvent.

When the method is performed and the arrangement is constructed in accordance with the present invention, they guarantee a uniform and economical coating, regardless of the working position of the arrangement. The thickness of the lubricant layer can be provided in simple way by the insertion of a respectively dimensioned nozzle in the outlet opening of the collecting container. Since the arrangement is formed as a closed system, the solvent contained in the lubricant cannot escape in the outside air, so that no solvent losses take place and special measures for health protection are no longer needed. The inventive arrangement and method are especially effective for such lubricants which contain an organic solvent. Another advantage of the inventive arrangement is that the latter can simultaneously be utilized for cooling so that the lubricant can simultaneously be used as cooling medium. In connection with this, the known cooling arrangements working with water as a cooling medium and the above-mentioned drying arrangements in which water must be removed from the material to be drawn, can be omitted. Thereby, the technological difficulties connected with insufficient drying of the material to be drawn, are eliminated.

Special advantages are attained when, in accordance with the invention, the granular filler is utilized. The lubricant poured into the granular filling continuously runs to the container bottom and flows off the latter, whereby the liquid does not stay still in the container and the contents of liquid reduces from the lubricant inlet to the outlet openings for the material to be worked. For these reasons, the material leaves the arrangement without liquid drops and with a lubricant film having optimum thickness. Special stripping off devices are not necessary. It is also emphasized that the great intensity of the lubricant coating is provided because the impurities and adhered particles on the material are stripped off by the granular filler thereby the formation of a closed lubricant film on the material is guaranteed.

The arrangement in accordance with the invention also possesses the advantage in that it can operate in a position which is inclined to the horizontal, it has a simple construction, and works without failures. The inventive process and arrangement provide for a high speed of drying. Thereby, it is possible to utilize continuously operating mechanical working devices and attain high drawing speed, for example during drawing of wire, wherein a solid lubricant containing a solvent is applied before the first drawing dye and between several drawing steps. The health protection and the fire protection in the case of the utilization of organic solvent is guaranteed because of the suction of the solvent. When the heat generated by the mechanical working and friction is utilized, the vapor pressure of the solution and/or dispersion means in the layer on the metallic material is increased and thereby the drying speed is considerably increased.

In multistage wire drawing processes, an intermediate coating and drying can provide for high wire drawing speed. The energy balance of the entire working process, for example wire drawing process, is substantially improved inasmuch as additional energy for vaporization and/or evaporation from outside is not needed or reduced to a minimum.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
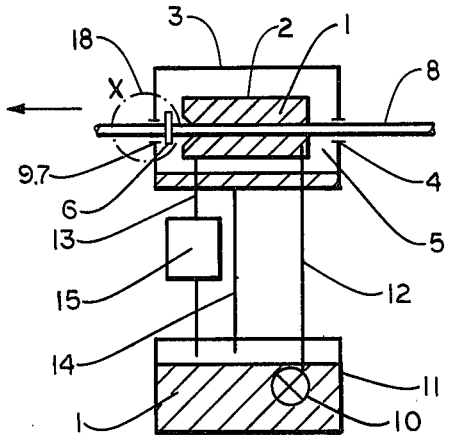
FIG. 1 is a view showing an arrangement for applying liquid lubricant.

An arrangement for applying and drying a liquid lubricant on a metallic material to be mechanically worked includes a coating container 2 accommodating a lubricant 1 and arranged in a closed lubricant collecting container 3, as shown in FIG. 1. Both containers 2 and 3 have inlet openings 4 and 5 and outlet openings 6 and 7 through which the material 8 to be coated passes.

Figure 3:
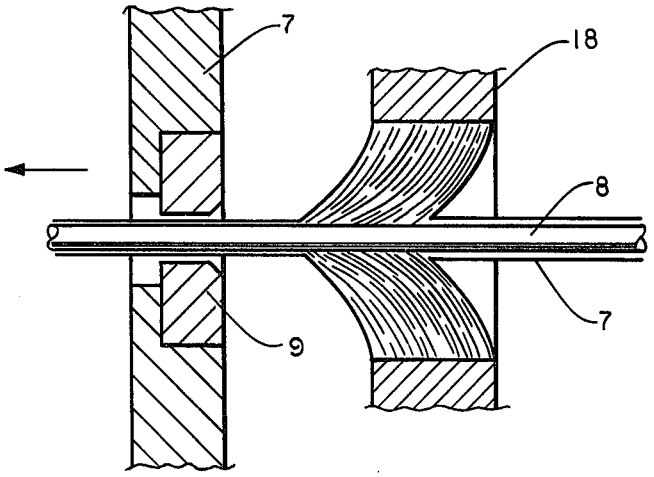
FIG. 3 is a part of the arrangement shown in FIGS. 1 and 2, as identified by reference letter "X"

A nozzle 9 which is more clearly shown in FIG. 3 is inserted in the outlet openings 7 of the collecting container 3. A lubricant film of a predetermined thickness can be obtained with the air of the nozzle 9. The coating container 2 is supplied with the lubricant 1 by means of a pump 10 from a closed lubricant reservoir 11 via a lubricant supply conduit 12. The collecting container 3 collects lubricant which exits through the outlet opening 6 and is stripped off by the nozzle 9. This portion of lubricant has not been utilized for the required coating.

The coating container 2 and the collecting container 3 are provided with a lubricant discharge conduit 13 and 14 which are open into the reservoir 11. A cooler 15 is arranged between the lubricant discharge conduit 13 of the coating container 2 and the reservoir 11.

Figure 2:
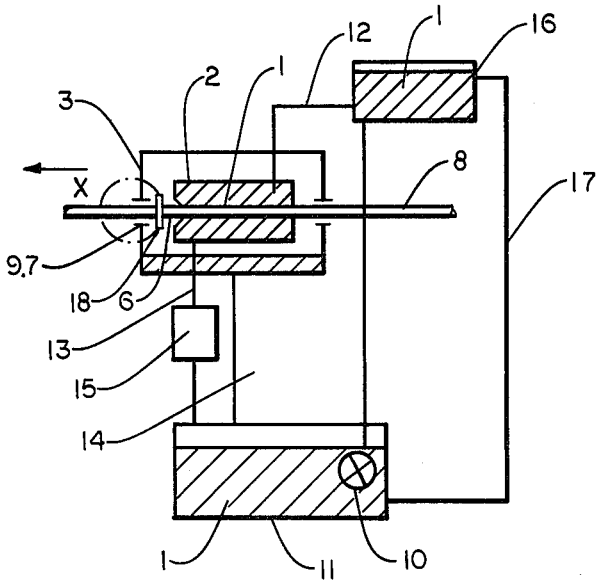
FIG. 2 is a view showing an arrangement for applying liquid lubricant in accordance with another embodiment of the invention.

The arrangement shown in FIG. 2 differs from the above-described arrangement in that the pump 10 does not directly supply the coating container 2, but instead a compensating container 16 is arranged therebetween. A predetermined filling height is maintained in the compensating container 16 by means of the pump 10 through a return conduit 17, whereby a predetermined lubricant pressure can be adjusted. A stripping element 18 (FIG. 3) is arranged between the nozzle 9 and the outlet opening 6 of the coating container 2. The stripping element 18 strips off superfluous lubricant from the material 8. The stripping element 18 is formed by a ring with concentrically arranged bristles. Calcium stearate dissolved in benzol or trichlorethylene can be utilized as lubricant 1.

Figure 4:
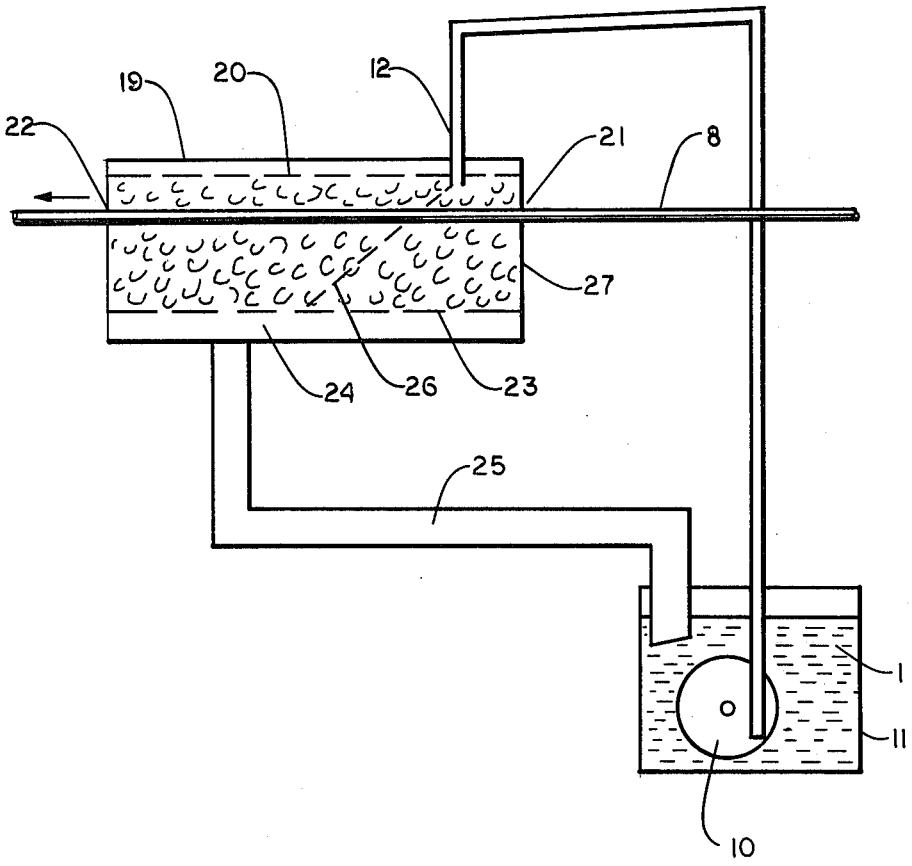
FIG. 4 is a view showing an arrangement for applying liquid lubricant, in accordance with a further embodiment of the present invention.

The arrangement shown in FIG. 4 includes a coating container 19 which is closed by a cover and completely filled with a granular filler 20. The granular filler 20 includes a plurality of granular particles constituted of polyethylene, a non-absorbent polymeric material. The coating container 19 has inlet and outlet openings 21 and 22 through which the material 8 to be coated passes. The lubricant supply conduit 12 opens in the granular filler 20 in the vicinity of the inlet opening 21. The lubricant is supplied to the lubricant supply conduit 12 from the lubricant pump 10 out of the lubricant reservoir 11. Calcium stearate dissolved in technical benzol or in trichloroethylene is utilized as the lubricant 1.

A portion of the lubricant which is supplied to the granular filler 20 forms a lubricant film on the material 8, whereas the other remaining portion runs to the container bottom and flows through a sieve 23 into a lubricant collecting zone 24. From there the lubricant flows through a lubricant discharge conduit 25 into the lubricant reservoir 11. Lines 26 and 27 surround a zone in the granular filler, which forms a self-adjustable region with high lubricant contents. In this region, the coating takes place. Outside this region, the superfluous lubricant is stripped off and thereby the applied lubricant film becomes thin and homogeneous.

Figure 5:
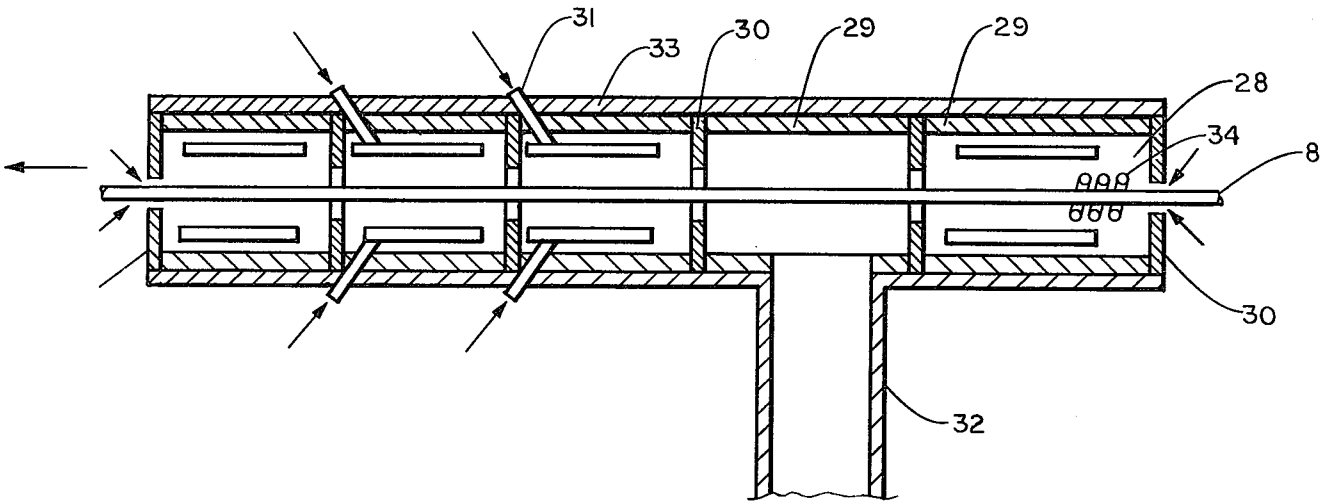
FIG. 5 is a view showing a drying channel for drying the applied liquid lubricant.
Figure 6:
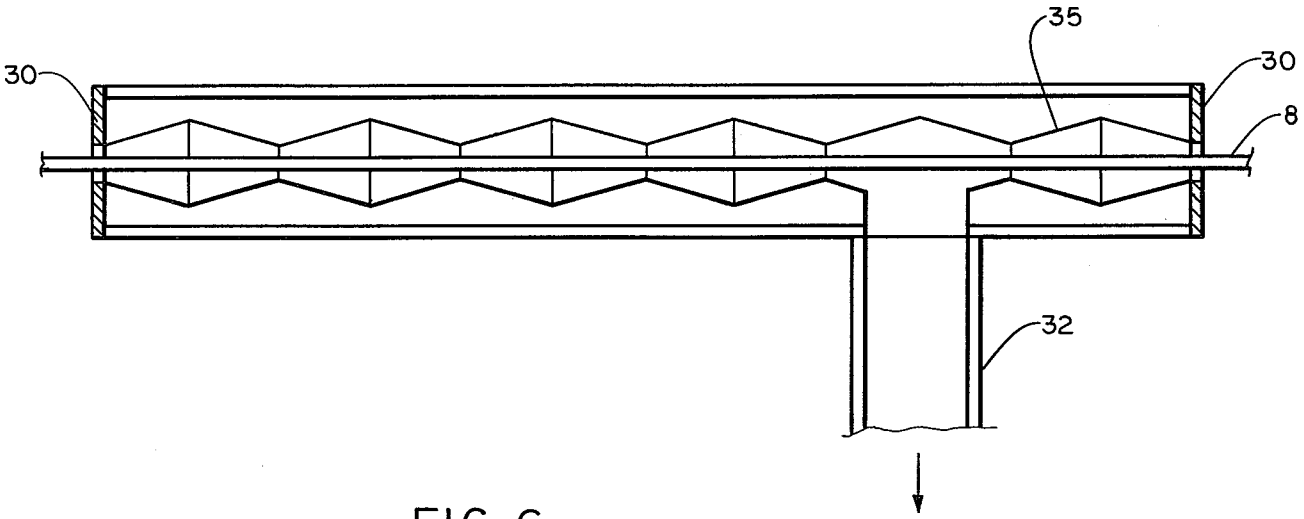
FIG. 6 is a view showing a drying channel for drying the applied liquid lubricant, in accordance with a further embodiment of the invention.

The coated material 8 is then transported through a drying channel shown in FIGS. 5 or 6. A drying channel 28 of FIG. 5 is provided with baffles 30 arranged between spacing pipes 29. The baffles 30 provided at the ends of the drying channel 28 has smaller throughgoing openings for the metallic material 8 than the baffles located inside the same. Pipes 31 are inserted in the chambers formed between the baffles 30 and are arranged for passing air in dosed quantities.

With the aid of a not shown air suction device, outside air is aspirated via a suction pipe 32 through the drying channel 29. The outside air enters the drying channel through the openings in the outer baffles 30 and via the pipes 31. With the aid of the inner baffles 30 and the air aspirated via the pipe 31, a turbulent air stream and pressure change take place. The air aspirated via the pipe 31 reduces the concentration of solvent through the layer of lubricant. The air or drying conditions can be brought to an optimum by changing the air inlet openings.

The air is heated in the interior of the drying channel 28 by a source of heat 33 formed by heating cartridges. Moreover the material 8 is heated by a high frequency inductor 34 arranged in the inlet of the drying channel 28. The aspirated air containing solvent vapors travels to a not shown solvent recuperating device.

Instead of the drying channel shown in FIG. 5, another drying channel shown in FIG. 6 can be utilized. For obtaining a turbulent air stream, the inner baffles 30 of the drying channel of FIG. 5 are replaced by conical nozzles 35. When the material 8 leaves the drying channel 28, it is coated by a homogeneous strong and firmly adherent lubricant film of calcium stearate which guarantees excellent lubricating condition for subsequent mechanical working of the material.

It will be understood that each of the elements described above, or two or more together, may also find a useful application in other types of constructions differing from the types described above.

While the invention has been illustrated and described as embodied in a method and arrangement for applying and drying a liquid lubricant on a metallic material to be mechanically worked, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, farily constitute essential characteristics of the generic or specific aspects of this invention.

What is claimed as new and desired to be protected by Letters Patent is set forth in the appended claims.

1. An arrangement for applying and drying a liquid lubricant on a metallic material to be mechanically worked, particularly a lubricant including an organic solvent and a solid or semi-solid lubricating substance, the arrangement comprising a closed coating container arranged to accommodate a lubricant, said coating container forming a part of a closed lubricant circuit and having inlet and outlet openings so that a metallic material passes through said coating container via said openings and the lubricant coats the metallic material whereupon the latter exits from the coating container through one of said openings, said coating container having a sieve located in the interior of the same and a granular material arranged above said sieve and in the region of said inlet and outlet openings, so that a lubricant collecting zone is formed below said sieve, and coating container also having a lubricant supply opening which opens into said granular material above said sieve, and a lubricant discharge opening which leads from said lubricant collecting zone below said sieve; means for removing the superfluous portion of lubricant which exits via said one opening without contacting the superfluous portion of lubricant with outside air; a drying channel located downstream of said removing means and said coating container and arranged to pass the lubricant coated metallic material therethrough; means for urging air through the interior of said drying channel and connected with the latter; and means for disturbing the air in said drying channel.

2. An arrangement as defined in claim 1, wherein said air urging means includes an air aspirating device.

3. An arrangement as defined in claim 1, wherein said air urging means includes an air blowing device.

4. An arrangement as defined in claim 1; and further comprising solvent recuperating means connected with said drying channel.

5. An arrangement as defined in claim 1, wherein said air urging means is arranged to generate a turbulent air stream along said channel.

6. An arrangement as defined in claim 1, wherein said air urging means is arranged to generate a pressure change along said channel.

7. An arrangement as defined in claim 1, wherein said openings of said coating container include an inlet opening and an outlet opening; an further comprising a collecting container having further inlet and outlet openings for passing the lubricant coated metallic material therethrough, and a nozzle provided in the further outlet opening of said collecting container and arranged for obtaining on the metallic material a lubricant layer of a predetermined thickness.

8. An arrangement as defined in claim 1; and further comprising a lubricant reservoir connected with said lubricant collecting zone of said coating container via said lubricant discharge opening.

9. An arrangement as defined in claim 1, wherein said drying channel has an inner passage through which the air is urged, said disturbing means including formations arranged in said inner passage.

10. An arrangement as defined in claim 9, wherein said formations of said disturbing means include a plurality of baffles subdividing said inner passage into a plurality of chambers.

11. An arrangement as defined in claim 9, wherein said formations of said disturbing means include a plurality of nozzles arranged in said inner passage.

12. An arrangement as defined in claim 1, wherein said drying channel has an inner passage through which the air is urged; and further comprising a plurality of pipes which opens into said inner passage and arranged to pass air therethrough so as to obtain the turbulent air stream and to reduce the concentration of the solvent.

* * * * *